US008387339B2

(12) United States Patent
Birch et al.

(10) Patent No.: US 8,387,339 B2
(45) Date of Patent: Mar. 5, 2013

(54) ADJUSTABLE WALL SUPPORT SYSTEM AND METHOD

(75) Inventors: Julia Ann Birch, Kokomo, IN (US); Bryan Thomas Welch, Noblesville, IN (US); Aaron Earl Daniel, Boise, ID (US)

(73) Assignee: Modernfold, Inc., Greenfield, IN (US)

( * ) Notice: Subject to any disclaimer, the term of this patent is extended or adjusted under 35 U.S.C. 154(b) by 34 days.

(21) Appl. No.: 13/090,686

(22) Filed: Apr. 20, 2011

(65) Prior Publication Data

US 2011/0252729 A1 Oct. 20, 2011

Related U.S. Application Data

(60) Provisional application No. 61/326,007, filed on Apr. 20, 2010.

(51) Int. Cl.
*E04B 1/00* (2006.01)
*E04H 1/00* (2006.01)
*E04H 12/18* (2006.01)

(52) U.S. Cl. ..... 52/745.09; 52/645; 52/646; 52/243.1

(58) Field of Classification Search ..... 52/243.1, 52/238.1, 645, 646, 745.09
See application file for complete search history.

(56) References Cited

U.S. PATENT DOCUMENTS

| | | | | |
|---|---|---|---|---|
| 3,062,340 | A * | 11/1962 | Hunnebeck | 52/646 |
| 3,327,440 | A * | 6/1967 | Watkins | 52/239 |
| 4,449,564 | A | 5/1984 | Hansen et al. | |
| 4,658,878 | A * | 4/1987 | Williams | 160/84.09 |
| 4,683,677 | A | 8/1987 | Jurgensen | |
| 4,724,883 | A | 2/1988 | Liebowitz | |
| 4,745,724 | A * | 5/1988 | Reetz | 52/632 |
| 4,821,480 | A * | 4/1989 | Silvey | 52/632 |
| 5,301,482 | A * | 4/1994 | Aspenwall | 52/223.1 |
| 5,524,854 | A * | 6/1996 | McSwain et al. | 248/354.1 |
| 5,642,593 | A * | 7/1997 | Shieh | 52/239 |
| 6,050,045 | A * | 4/2000 | Campbell | 52/645 |
| 6,079,174 | A * | 6/2000 | Williams et al. | 52/243.1 |
| 6,192,962 | B1 | 2/2001 | Glover | |
| 6,243,996 | B1 * | 6/2001 | Oliver et al. | 52/126.1 |
| 6,318,044 | B1 * | 11/2001 | Campbell | 52/645 |
| 6,330,902 | B1 | 12/2001 | Chen | |
| 6,698,152 | B1 * | 3/2004 | Bush | 52/650.1 |
| 6,945,301 | B1 | 9/2005 | Nien | |
| 7,621,313 | B2 | 11/2009 | Pham | |

(Continued)

FOREIGN PATENT DOCUMENTS

| | | |
|---|---|---|
| CN | 2559273 | 6/2002 |
| DE | 19540934 | 11/1995 |
| EP | 1 859 710 A1 | 11/2007 |
| FR | 2898629 | 3/2006 |
| WO | WO 2005/062845 | 7/2005 |
| WO | WO 2008/132888 A1 | 11/2008 |

OTHER PUBLICATIONS

PCT International Search Report from corresponding PCT International Application PCT/US2011/033224.

(Continued)

*Primary Examiner* — Mark Wendell
(74) *Attorney, Agent, or Firm* — Faegre Baker Daniels LLP

(57) ABSTRACT

An adjustable support system and method for supporting for an operable partition includes an adjustable length overhead truss. The adjustable length overhead truss is supported at opposite ends by first and second vertical supports. A track is coupled to the adjustable length overhead truss, and a plurality of wall panels are coupled to the track. The plurality of wall panels are movable from a folded storage position to a deployed use position to form a wall under the adjustable length overhead truss.

25 Claims, 7 Drawing Sheets

U.S. PATENT DOCUMENTS

| | | | | |
|---|---|---|---|---|
| 7,669,379 | B2 * | 3/2010 | Schierding | 52/634 |
| 2002/0116891 | A1 * | 8/2002 | Waldrop | 52/632 |
| 2003/0041548 | A1 * | 3/2003 | Merrifield | 52/646 |
| 2005/0225172 | A1 * | 10/2005 | Brightwell | 305/107 |
| 2006/0107611 | A1 * | 5/2006 | Merrifield | 52/646 |
| 2006/0236644 | A1 * | 10/2006 | Bush | 52/634 |
| 2007/0187050 | A1 | 8/2007 | Jensen | |
| 2010/0218452 | A1 * | 9/2010 | Wolf et al. | 52/702 |

OTHER PUBLICATIONS

PCT International Written Opinion from corresponding PCT International Application PCT/US2011/033224.

HUFCOR, Unispan Self Support System product brochure; May 2006, 2 pages.

HUFCOR, Unispan Product profile brochure, 2006, 3 pages.

* cited by examiner

ADJUSTABLE WALL SUPPORT SYSTEM AND METHOD

CROSS REFERENCE TO RELATED APPLICATION

This application claims the benefit of U.S. Provisional Application Ser. No. 61/326,007, filed on Apr. 20, 2010, which is incorporated herein by reference.

BACKGROUND AND SUMMARY

The present disclosure relates to movable wall systems operable to partition a large room into a smaller room. More particularly, the present disclosure relates to an adjustable support structure system and method to facilitate installation of an overhead track in the room for supporting the operable partitions.

Operable walls or partitions, also known as movable wall panel systems, find useful applications in a variety of venues such as classrooms, offices, convention facilities, hospitals or the like. In these venues, the operable partitions are often moved along overhead tracks from which the partitions are suspended. The partitions are movable along the tracks to separate or compartmentalize larger rooms into smaller rooms or areas. The operable partitions are typically connected to trolleys that roll within the overhead track. The track is suspended from a support structure which is typically located above the ceiling of a room in which the operable partitions are installed.

The present disclosure provides an adjustable support structure to support a track for the operable partitions. In one illustrated embodiment, the support structure includes a plurality of vertical supports located adjacent opposite walls in the room in which the operable partitions are to be installed. The vertical supports are columns having an adjustable height to facilitate installation of the support structure in rooms having different ceiling heights. An adjustable length overhead truss extends between first and second vertical supports located on opposite sides of the room. In an illustrated embodiment the adjustable overhead truss includes a first truss member coupled to a first vertical support, a second truss member coupled to a second vertical support, and an intermediate or center truss member that moves relative to the first and second truss members to adjust the length of the truss to fit within the room.

The adjustable support structure engages the floor of the room. Therefore, the floor supports the weight of the adjustable overhead truss. A track support member is coupled to the overhead truss to support a track. In use, panels of a movable wall are suspended from the track for movement between a folded or stored position and an extended use position. The portable wall system of the present disclosure may be first set up in a first environment needing a portable wall having a first length dimension and subsequently set up in a second environment needing a portable wall of a second length dimension.

According to one illustrated embodiment of the present disclosure, an adjustable support system is provided for an operable partition including a plurality of wall panels supported by a track to divide a room into a smaller area. The support system includes an adjustable length overhead truss including first and second end truss members and a center truss member movable relative to at least one of the first and second end truss members to adjust a length of the overhead truss. The system also includes a first vertical support including a first end supported by a floor of the room and a second end coupled to the first end truss member, and a second vertical support including a first end supported by the floor of the room and a second end coupled to the second end truss member. The system further includes a track coupled to the adjustable length overhead truss, and a plurality of wall panels coupled to the track. The plurality of wall panels are movable from a folded storage position to a deployed use position to form a wall under the adjustable length overhead truss.

In an illustrated embodiment, at least one of the first and second end truss members includes an open end configured to receive an end portion of the center truss member therein so that the center truss member is movable relative to at least one of the first and second end truss members to adjust the length of the overhead truss. Also in an illustrated embodiment, the center truss member includes a plurality of modular truss sections coupled together to form the center truss member. The first and second vertical supports each include a height adjustment mechanism configured to adjust the height of the adjustable length overhead truss.

According to another illustrated embodiment of the present disclosure, a method is provided for supporting an operable partition including a plurality of wall panels supported by a track to divide a room into a smaller area. The method includes providing an adjustable length overhead truss including first and second end truss members and a center truss member movable relative to at least one of the first and second end truss members to adjust a length of the overhead truss. The method also includes adjusting a length of the overhead truss to a dimension of the room, supporting the first end truss member with a first vertical support including a first end supported by a floor of the room and a second end coupled to the first end truss member, and supporting the second end truss member with a second vertical support including a first end supported by the floor of the room and a second end coupled to the second end truss member. The method further includes coupling a track to the adjustable length overhead truss, coupling a plurality of wall panels to the track, and moving the plurality of wall panels from a folded storage position to a deployed use position to form a wall under the adjustable length overhead truss.

In an illustrated embodiment, the step of providing an adjustable length overhead truss includes providing identically shaped first and second end truss members, providing a plurality of identically shaped modular truss sections, assembling a plurality of the modular truss sections to form the center truss member, and coupling the center truss member to the first and second end truss members. In an illustrated embodiment, the step of adjusting a length of the overhead truss to a dimension of the room includes moving the opposite ends of the center truss member relative to the first and second end truss members in a telescoping manner. An illustrated embodiment also includes adjusting a height of opposite ends of the adjustable length overhead truss using height adjustment mechanisms of the first and second vertical supports, respectively.

Additional features of the present system and method will become apparent to those skilled in the art upon consideration of the following detailed description of illustrative embodiments exemplifying the best mode of carrying out the present system and method as presently perceived.

BRIEF DESCRIPTION OF THE DRAWINGS

The above-mentioned and other features of this disclosure, and the manner of attaining them, will become more apparent and the disclosure itself will be better understood by reference to the following description of illustrated embodiments taken in conjunction with the accompanying drawings, wherein.

DETAILED DESCRIPTION OF THE DRAWINGS

Figure 1:
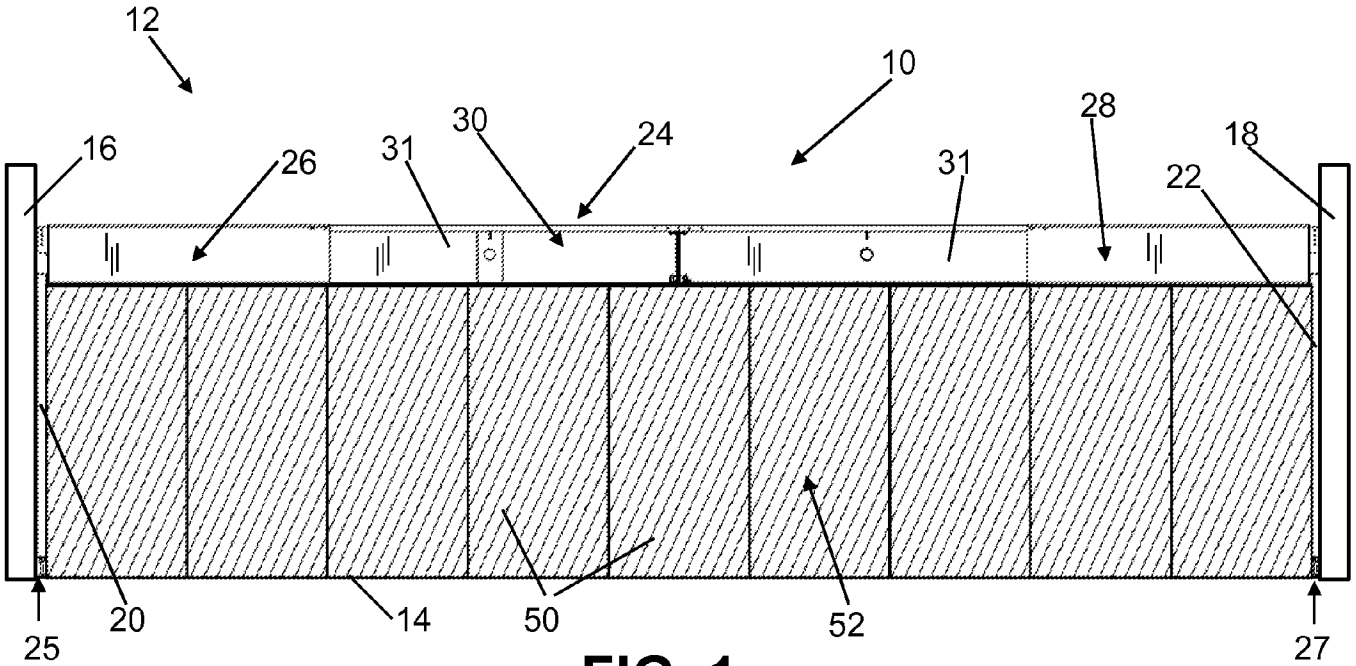
FIG. 1 is a side elevational view of an adjustable wall support structure configured to support a track for an operable partition including a plurality of wall panels shown in a deployed, use position to provide a wall within a room.

For the purposes of promoting an understanding of the principles of the present disclosure, reference will now be made to the embodiments illustrated in the drawings, which are described below. The embodiments disclosed below are not intended to be exhaustive or limit the present system to the precise form disclosed in the following detailed description. Rather, the embodiments are chosen and described so that others skilled in the art may utilize their teachings. Therefore, no limitation of the scope of the claimed present system or method is thereby intended. The present system and method includes any alterations and further modifications of the illustrated devices and described methods and further applications of the principles of the present disclosure which would normally occur to one skilled in the art. Corresponding reference numbers in the drawings indicate corresponding parts throughout several views.

The present disclosure relates to a self supported wall system that may be erected in an environment such as in a room of a building. Traditionally, support structures for such self supported wall systems are designed to be a fixed length. However, not every environment is the same size. Therefore, conventional support structures are often custom built to exact dimensions taken within the room.

Referring to FIG. 1, a support structure 10 for a portable wall system or operable partition is shown. The support structure 10 used in an environment 12, such as a room within a building, having a floor 14 and opposing walls 16 and 18. The support structure 10 includes a first vertical support 20, a second vertical support 22, and an overhead truss assembly 24 supported by the first and second vertical supports 20, 22. In one embodiment, the vertical supports 20 and 22 are free standing. In another embodiment, the vertical supports 20 and 22 are coupled to walls 16 and 18, respectively, or other structures within the room by bracing supports as discussed below. Vertical supports 20 and 22 illustratively include adjustable feet 25 and 27, respectively, so that a height of the truss 24 of support structure 10 is adjustable.

Figure 6:
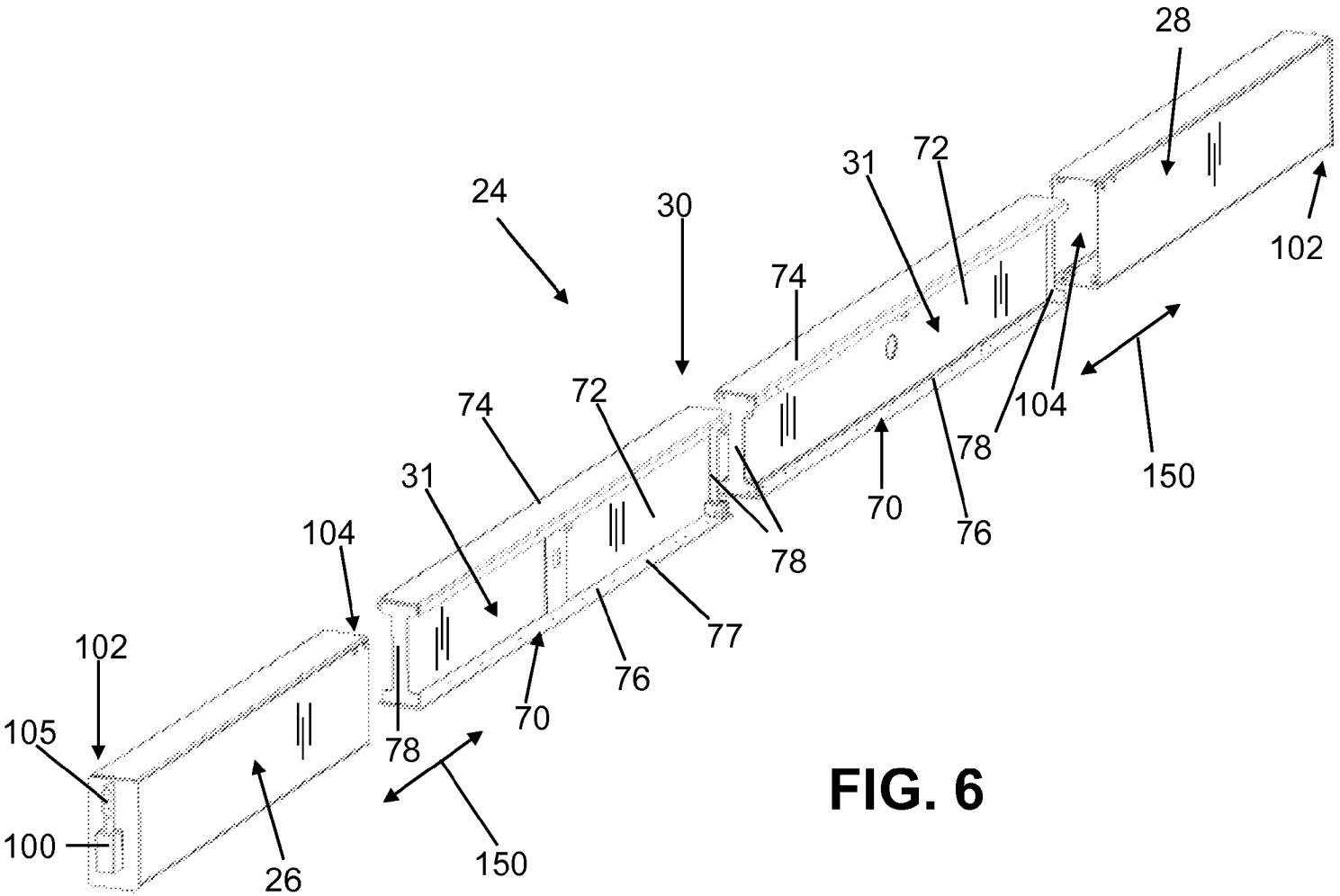
FIG. 6 is an exploded perspective view illustrating details of first and second end truss members and an intermediate or center truss member, including two modular truss sections, which is received within open ends of the first and second truss members to provide an adjustable length truss.

Overhead truss 24 has an adjustable length to permit support structure 10 to fit into rooms 12 of different sizes. Overhead truss 24 includes a first truss member 26 coupled to first vertical support 20, a second truss member 28 coupled to second vertical support 22, and a third intermediate or center truss member 30 which spans between first and second truss members 26 and 28. As best shown in FIG. 6, opposite end portions of center truss member 30 are received through open ends 104 and into interior regions of first truss member 26 and second truss member 28.

Figure 9:
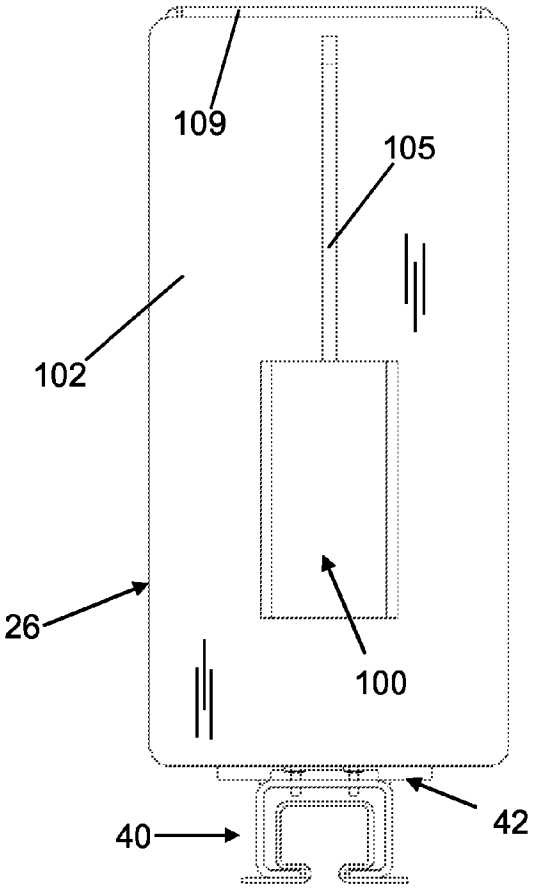
FIG. 9 is an end view illustrating details of the first and second end truss members and a track supported by the truss for supporting trolleys of the wall panels of the operable partitions.

Overhead truss 24 is expanded or contracted in length due to the telescoping relationship of center truss member 30 relative to first and second truss members 26 and 28 to fit within the current building environment 12. During installation, the first and second truss members 26 and 28 are located over opposite ends of the third truss member 30 as shown in FIGS. 1-4. The entire truss assembly 24 is then lifted up, extended to the proper length, and coupled at opposite ends to the vertical supports 20 and 22. The adjustable feet 25 and 27 or other height adjustment mechanisms are then adjusted to level the truss 24 or fine tune the height of the truss 24 within the room. Typically, the truss height is adjusted so that a track 40 coupled to the truss 24 (as shown in FIG. 9) is at the height of a ceiling or slightly above the height of the ceiling. A track support member 42 is coupled along a bottom portion of overhead truss 24 for supporting the track 40.

Panels 50 of a movable wall 52 are suspended from the track 40 by a trolley located within the track 40. Therefore, the panels 50 are movable between a folded (stored) position shown in FIG. 2 and an extended or deployed (use) position shown in FIG. 1. Movable wall 52 illustratively includes either a plurality of two panel segments or a plurality of panels 50 hinged together to formed a continuous wall 52.

Figure 3:
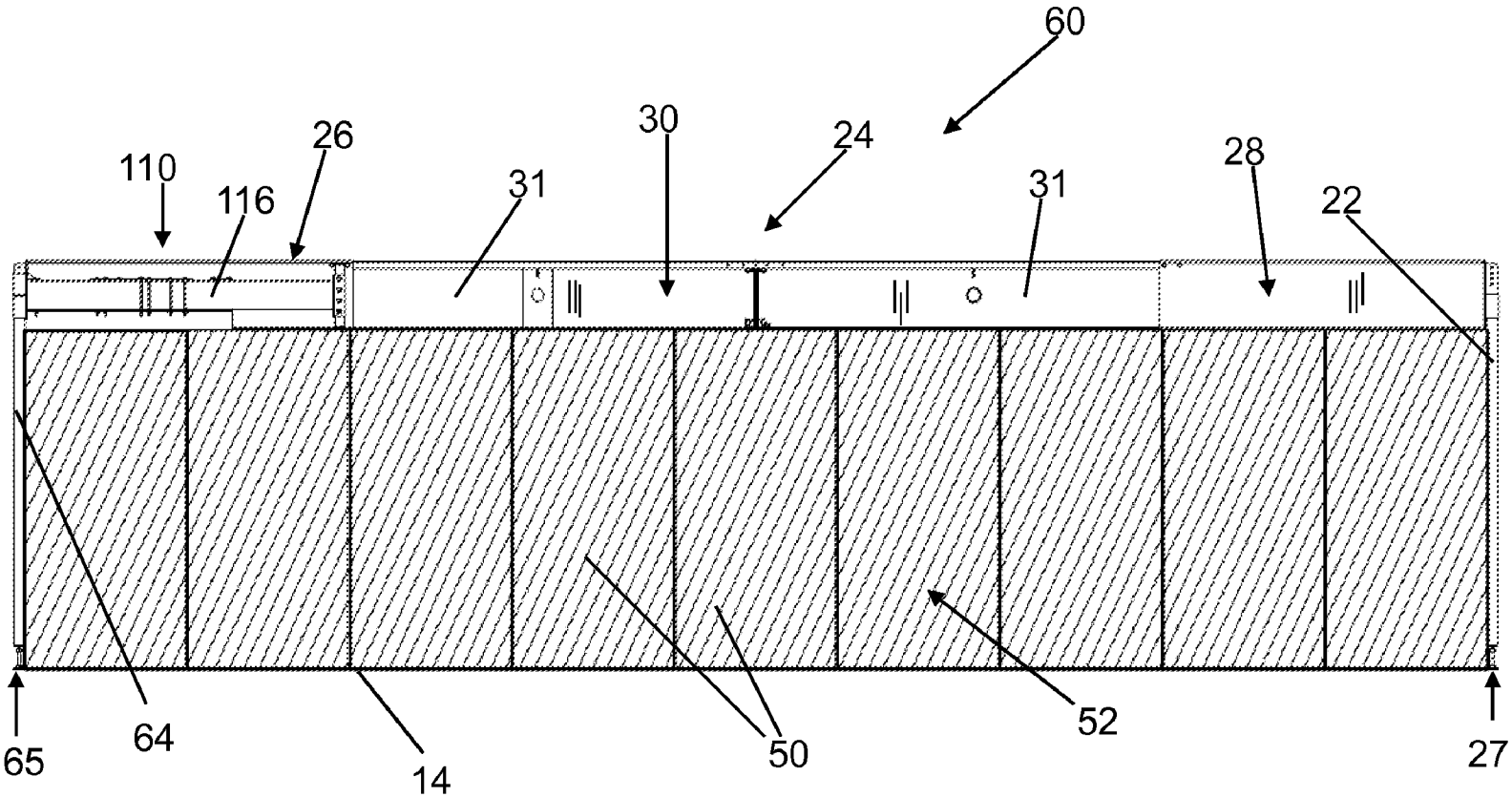
FIG. 3 is a side elevational view of another embodiment of the present disclosure including an additional laterally spaced vertical support located adjacent one end of the support structure with a plurality of wall panels shown in a deployed, use position to provide a wall within a room.
Figure 4:
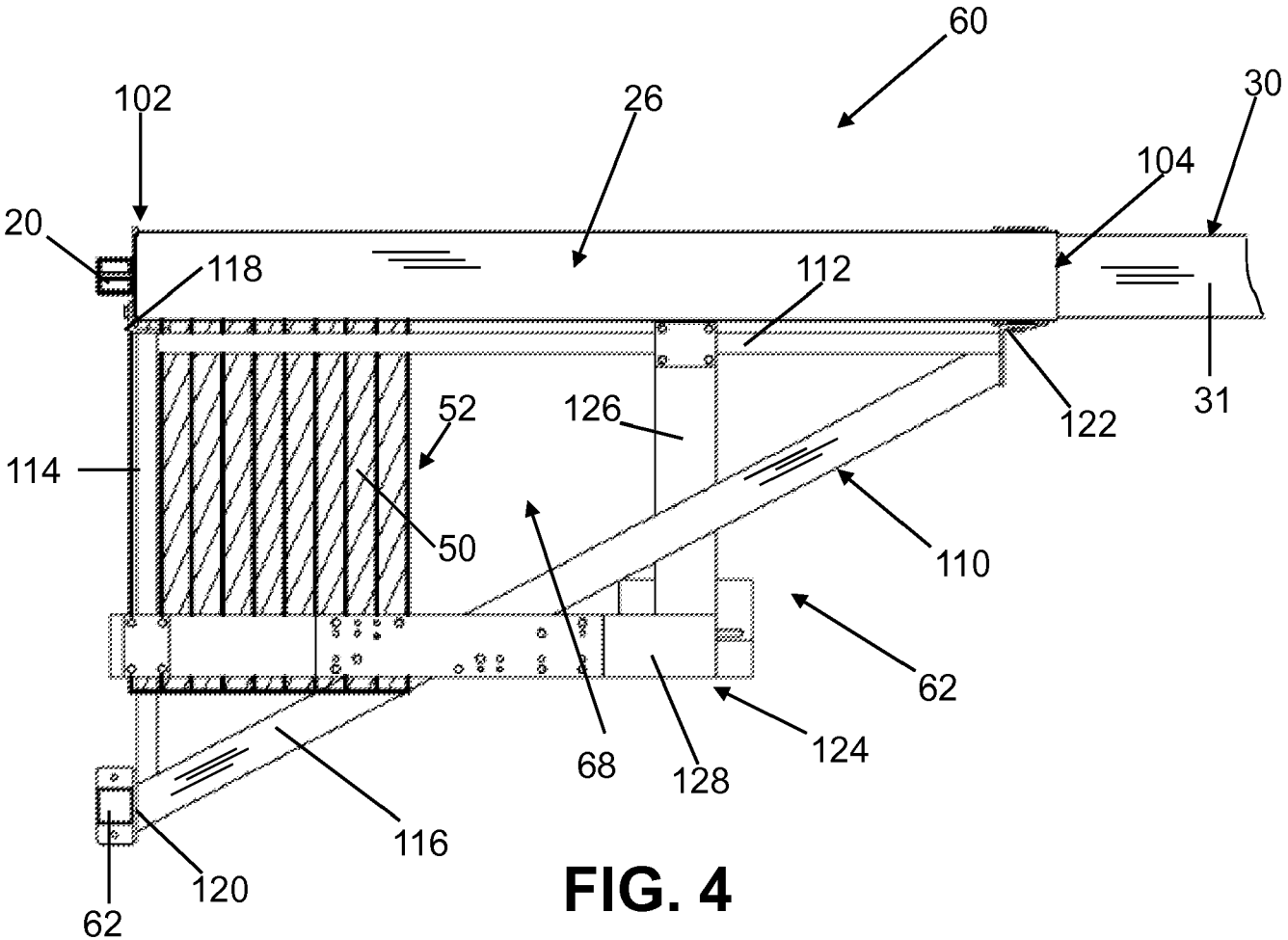
FIG. 4 is a top view of one end of the support structure of FIG. 3 illustrating details of the laterally spaced vertical support.
Figure 5:
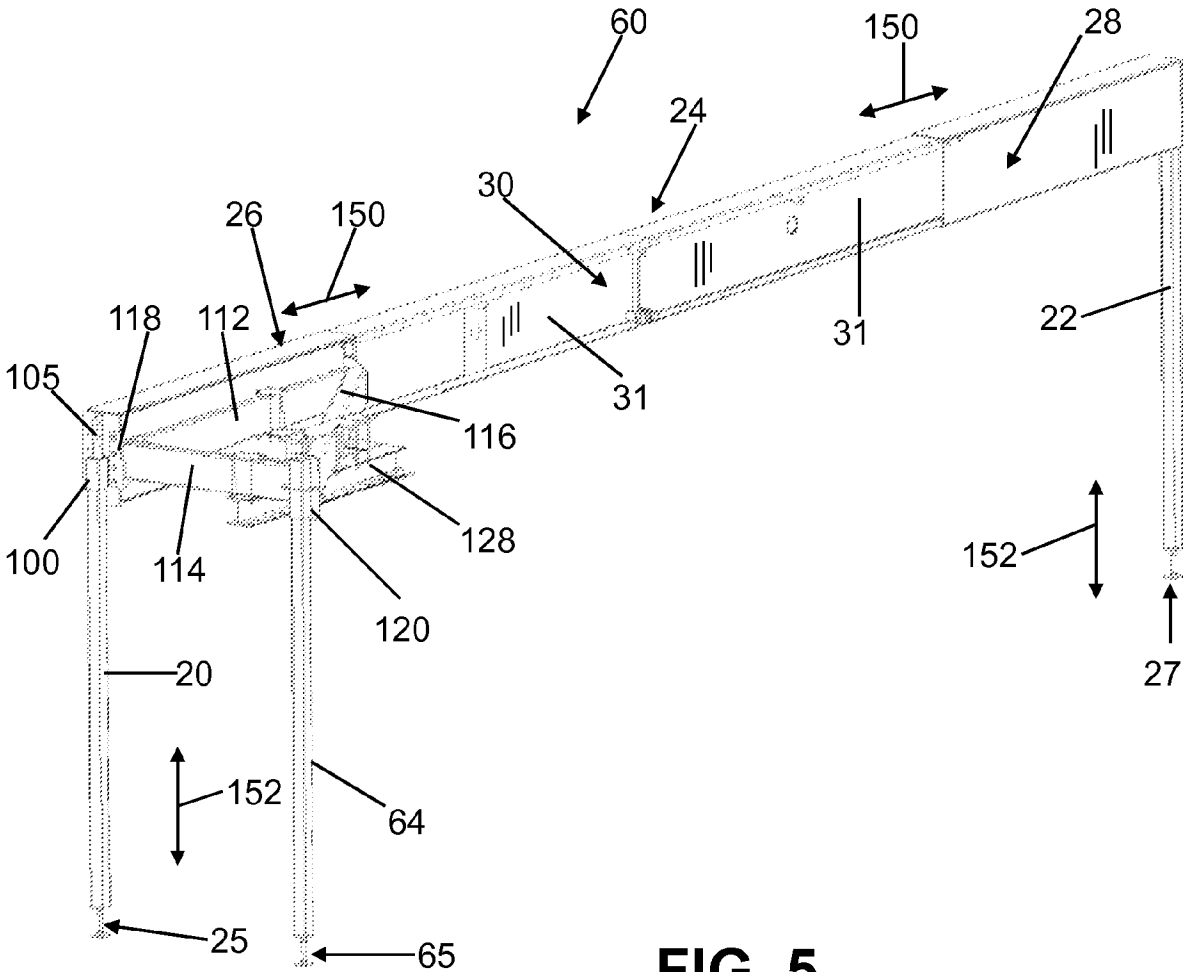
FIG. 5 is a perspective view of the support structure of FIGS. 3 and 4.

Referring now to FIGS. 3-5, another embodiment of support structure 60 is illustrated. A laterally spaced vertical support assembly 62 is provided adjacent first vertical support 20. Vertical supports 20 and 64 are coupled together by a beam 114 which is coupled to first overhead truss member 26. Vertical support assembly 62 defines a storage area 68 best shown in FIG. 4 into which the panels 50 of moveable wall 52 are placed when in a stored position.

The adjustable support structure 10 of the present disclosure may be used with many different varieties of operable partitions and track systems. For example, single panel systems, paired panel systems, continuously hinged panel systems or accordion panel systems may be used. The panels may have various interface options and drop seal options such as, for example, "Acousti-Seal® Operable Partitions", "Multi-Directional Aluminum Suspension Systems RT100/RT200", "Smart Track™ Programmable Steel Suspension Systems" or systems available from Modernfold, Inc., the specifications of which are incorporated herein by reference.

FIGS. 6-9 illustrate details of the first and second truss members 26 and 28 and the center truss member 30. In an illustrated embodiment of the present disclosure, the first and second truss members 26 and 28 are box shaped truss members configured to be coupled to vertical supports 20 and 22. In one embodiment, a single piece center truss member 30 extends between first and second truss members 26 and 28. In another embodiment, center truss member 30 includes a plurality of modular sections 31 coupled together to form the center truss 30. In FIG. 6, two separate modular truss sections 31 of center truss 30 are shown. Additional sections 31 may be coupled together, if needed, based on the room dimensions. In FIGS. 1-3 and 5, the modular sections 31 are shown coupled together as discussed below to form the center truss member 30 which moves or telescopes in and out of first and second truss members 26 and 28.

Figure 7:
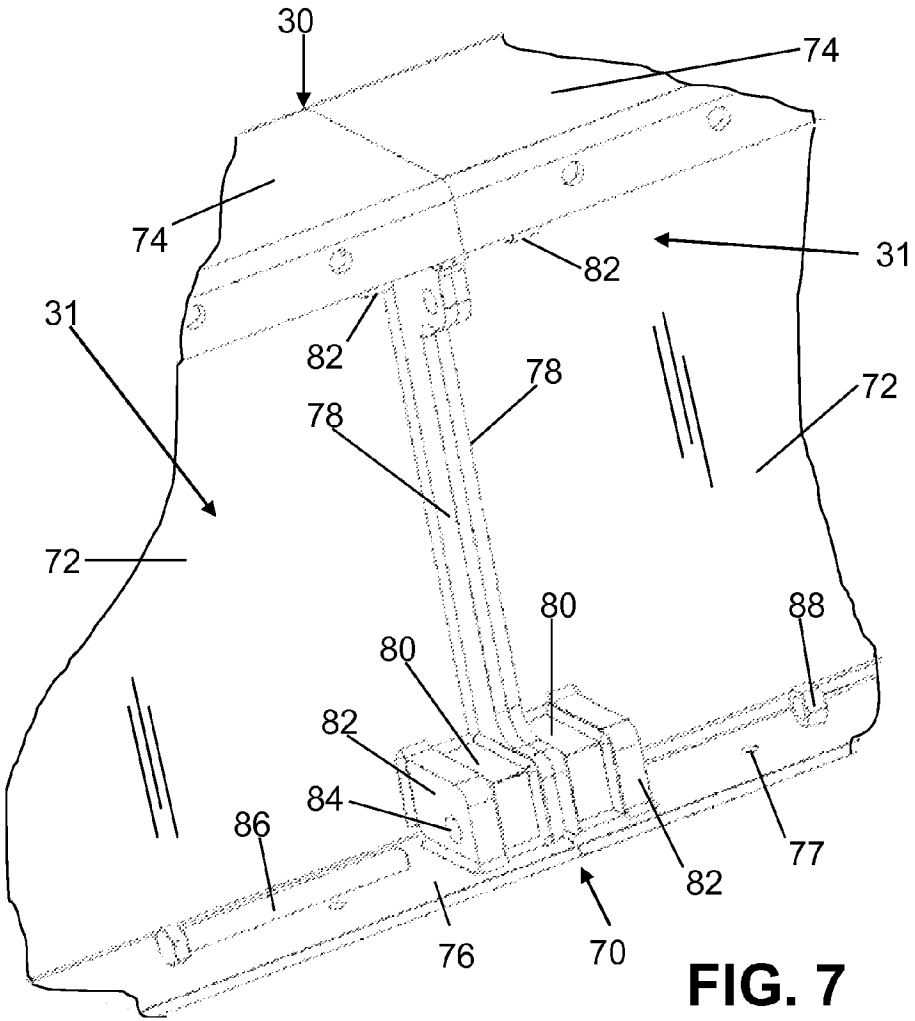
FIG. 7 is an enlarged perspective view showing connection between adjacent modular truss sections of the center truss member.
Figure 8:
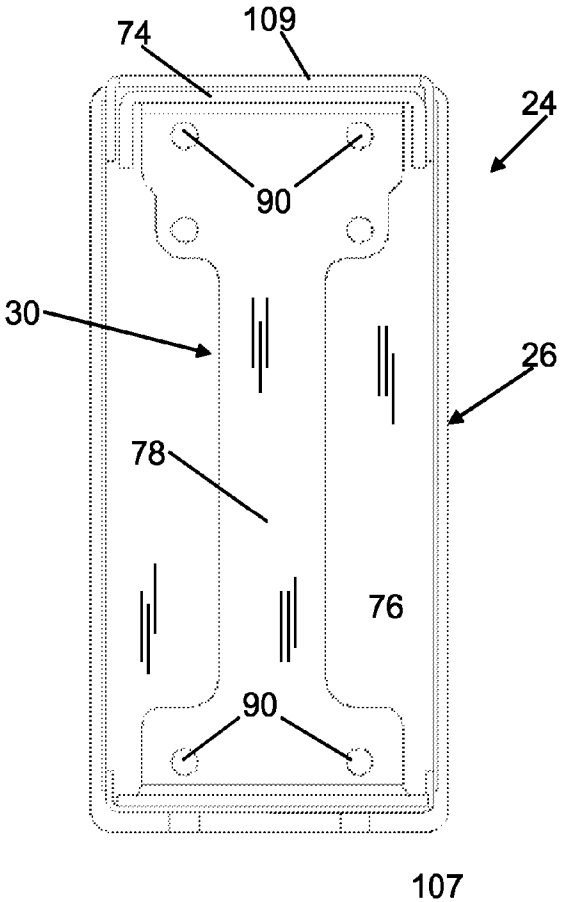
FIG. 8 is a sectional view taken through the assembled truss showing additional details of one of the end truss members and the center truss member.

The modular truss sections 31 illustratively include an I-beam assembly 70 formed from a center panel 72 which is coupled to a top panel 74 and a bottom panel 76. First and second ends of modular truss sections 31 each include an I-shaped support plate 78. As best shown in FIG. 7, each modular section 31 includes spacers 80 and fastening blocks 82 having apertures 84 formed therein. Apertures 84 are configured to receive fasteners, such as bolts 86, to couple adjacent modular truss sections 31 together. A nut 88 is coupled to the end of bolt 86 to secure the sections 31 together. FIG. 8 illustrates additional details of the I-shaped support plates 78 which include apertures 90 formed at locations aligned with the apertures 84 of fastening blocks 82.

FIG. 8 also illustrates details of the top panel 74 and bottom panel 76 of the I-beam assembly 70 of modular truss section 31. The bottom panel 76 is formed to include a plurality of apertures 77 (See FIGS. 6 and 7) to permit the track support member 42 to be coupled to the central truss member 30.

FIGS. 6-8 also illustrate details of the first and second truss members 26 and 28, which are interchangeable parts usable at either end of the truss 24. Each of the first and second truss members 26 and 28 has a coupling portion 100 coupled to a first closed end 102. The second ends 104 of the first and second truss members 26, 28 are open to receive end portions of the center truss member 30 in a sliding or telescoping fashion as illustrated by double-headed arrows 150. FIGS. 6-8 also illustrate details of formed channels 107, 109 used as bottom and top panels, respectively, of the first and second truss members 26 and 28.

The vertical supports 20 and 22 and the truss members 26, 28 and 30 are standard components which are mass produced and shipped to a building for assembly. A plurality of modular truss sections 31 are assembled together using fasteners such as bolts and nuts 86 and 88 to provide a necessary length for the center truss member 30 to span between the first and second truss members 26 and 28 located on opposite sides of the room 12. A first end of the center truss member 30 is inserted into open end 104 of first truss member 26. A second end of center truss member 30 is inserted into the open end 104 of second truss member 28. The entire truss member is then lifted upwardly in the room and coupled to vertical supports 20 and 22. In an illustrated embodiment, vertical supports 20 and 22 are coupled to coupling portions 100 with suitable fasteners. Height adjustment mechanisms 25 and 27 are then adjusted to fine tune the height of the truss 24.

Support brackets 105 are located on closed ends 102 of the first and second truss members 26 and 28. Support bracing (not shown) may be coupled to brackets 105 and to other structural components within the room 12 to add further stability to the truss 24, if necessary or desired. Once the length and height of truss 24 is positioned, and any bracing has been coupled to the truss 24, a track 40 is coupled to the truss 24 using track support member 42 which is coupled to the first and second truss members 26 and 28 and to center truss member 30.

Another embodiment of the present disclosure is illustrated in FIGS. 3-5. In this embodiment an additional vertical support 64 is added adjacent the first vertical support 20 to provide lateral support for the truss 24. This embodiment is used when additional lateral support is desired for stability, such as when the truss 24 supports single panel partition systems in which the panels 50 are stacked to one side of a centerline of the truss 24 as best shown in FIG. 4. In the embodiment of FIGS. 3-5 the vertical support structure includes a first vertical support 20 coupled to an end of the first truss member 26. A second vertical support 22 is coupled to second truss member. A third vertical support 64 is laterally spaced apart from the first vertical support 20.

An adapter 110, best shown in FIGS. 4 and 5, includes a first support beam 112 extending parallel to the first truss member 26, a second support beam 114 extending between the first and third vertical supports 20 and 64, and a third support beam 116 extending between the third vertical supports 64 and the first truss member 26 at an angle of about 45 degrees. A first mounting bracket 118 is coupled to the closed end 102 of the first truss member 26 as shown in FIGS. 4 and 5. A second mounting bracket 120 is coupled to the third vertical support 64. A third bracket 122 is coupled to the first truss member 26. An L-shaped support frame 124 having first and second legs 126 and 128 is coupled to the adapter 124 as best shown in FIG. 4 for additional stability.

Figure 2:
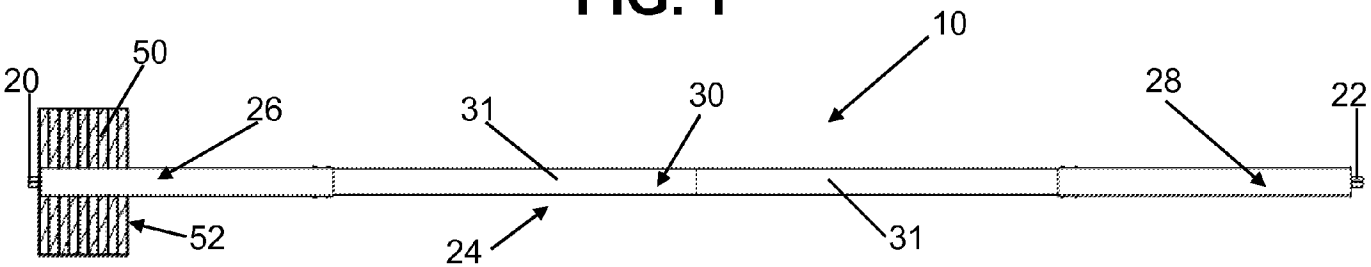
FIG. 2 is a top view of the support structure of FIG. 1 illustrating the plurality of wall panels in a storage position.

The truss assembly shown in FIGS. 3-5 is installed in a manner similar to FIGS. 1 and 2 discussed above. After the length of the truss 24 is adjusted by sliding the first and second truss member 26 and 28 relative to center truss member 30, the truss 24 is raised and positioned on the vertical supports 20, 22 and 64. The length adjustment of the truss 24 is illustrated by double headed arrows 150 in FIG. 5. Next, the height of truss 24 is adjusted using height adjustment mechanisms 25, 27 and 65 of vertical supports 20, 22 and 64, respectively. The height adjustment mechanisms adjust height of truss 24 as illustrated by double headed arrows 152 of FIG. 5. It is understood that other types of height adjustment mechanisms may be used in accordance with the present disclosure. For instance, in another embodiment height adjustment mechanisms are located in the coupling portions 100 of the first and second truss members 26 and 28. In an alternative embodiment, the vertical supports 20, 22 and 64 may be cut to a desired length without the use of height adjustment mechanisms.

The present disclosure has been described in connection with multiple embodiments to provide an adjustable support system in which an overhead support truss 24 is adjustable both vertically and horizontally to accommodate rooms or other environments having different configurations. The operable wall adjustable truss support system 10 and method allows the floor 14 to support the load of the operable wall system. As discussed above, first and second truss members 26, 28 are used for each span. One of the first and second truss members 26, 28 is located at each end of the span. A center or intermediate truss member 30 spans the distance between the first and second end truss members 26, 28. Illustratively, the center truss member 30 telescopes with respect to the first and second truss members 26, 28 to adjust the length of the entire truss 24 to fit the room.

In one illustrated embodiment, the center truss member 30 is formed from a plurality of modular sections 31. Therefore, the desired number of modules is assembled together at the installation location in order to span the entire dimension of the room 12. Once the plurality of modular truss sections 31 is assembled to form the center truss member 30, the first and second truss members 26, 28 are located over opposite end portions of the center truss member 30. Fine length adjustments of the truss 24 are made by sliding the center truss member 30 in and out of the first and second truss members 26, 28 in a telescoping fashion. The assembled truss assembly 24 is then lifted into place and attached to the top end of the vertical supports 20, 22. The height of the vertical supports 20, 22 is also adjustable. As discussed above, the height of the truss is adjusted using adjustable feet 25, 27 or other height adjustment mechanisms located at the top of the vertical supports 20, 22 to fine tune the height of the truss 24. The adjustable height mechanisms 25, 27 are also used to level the truss 24. A plurality of hanger brackets or track support members 42 are coupled to the truss 24 at spaced apart locations to support a track 40 for the operable wall panels 50.

In another illustrated embodiment, the center truss member 30 is movable relative to one of the first and second truss members 26 and 28 and fixed relative to the other of the first and second truss members 26 and 28 to provide the adjustable length truss 24. In another illustrated embodiment, the center truss member 30 includes open end portions configured to receive ends of the first and second truss members 26 and 28 therein. The center truss member 30 is movable relative to the first and second truss members 26 and 28 to provide the adjustable length truss 24.

The adjustable support structure 10 of the present disclosure is therefore adjustable for both height and width settings of the truss 24. Therefore, knowledge of the exact measurements of the building site prior to truss system fabrication is not required. The modular components are mass produced, shipped to the building site, and assembled to the desired lengths.

While this disclosure has been described as having exemplary designs and embodiments, the present system may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. An adjustable support system for an operable partition including a plurality of wall panels supported by a track to divide a room into a smaller area, the support system comprising:

an adjustable length overhead truss including first and second end truss members and a center truss member movable relative to at least one of the first and second end truss members to adjust an overall length of the adjustable support system for the operable partition by changing a length of the overhead truss;

a first vertical support including a first end supported by a floor of the room and a second end coupled to the first end truss member;

a second vertical support including a first end supported by the floor of the room and a second end coupled to the second end truss member;

a track coupled to the adjustable length overhead truss; and a plurality of wall panels coupled to the track, the plurality of wall panels being movable from a folded storage position to a deployed use position to form a wall under the adjustable length overhead truss.

2. The system of claim 1, wherein at least one of the first and second end truss members includes an open end configured to receive an end portion of the center truss member therein so that the center truss member is movable relative to at least one of the first and second end truss members to adjust the length of the overhead truss.

3. The system of claim 1, wherein the center truss member includes a plurality of modular truss sections coupled together to form the center truss member having a desired length.

4. The system of claim 3, wherein each modular truss section includes an I-beam assembly having first and second support plates located at opposite ends thereof to permit attachment of each modular truss section to an adjacent modular truss section.

5. The system of claim 4, wherein each I-beam assembly includes a center panel, a top panel, and a bottom panel extending between the first and second support plates to form the modular truss section.

6. The system of claim 5, wherein the bottom panel of each I-beam assembly is formed to include a plurality of apertures configured to receive fasteners to couple the track to the center truss member.

7. The system of claim 3, wherein each modular truss section includes a plurality of mounting blocks located adjacent the support plates and a plurality of spacers located between the mounting blocks and the support plates, the fastening blocks, spacers, and support plates being configured to receive a fastener therethrough to secure adjacent modular truss sections together to form the center truss member.

8. The system of claim 1, wherein each of the first and second end truss members includes an open end to provide access to an interior region of the first and second end truss members, the open ends of the first and second truss members being configured to receive opposite ends of the center truss member therein, the center truss member being movable within the interior regions of the first and second end truss members to adjust the length of the overhead truss.

9. The system of claim 1, wherein the first and second end truss members each include a coupling portion configured to couple the first and second end truss members to the first and second vertical supports, respectively.

10. The system of claim 1, wherein the first and second end truss members each include a brace support bracket configured to be coupled to at least one bracing member to provide additional support for the adjustable length overhead truss.

11. The system of claim 1, wherein the plurality of wall panels are located below a longitudinal axis of the adjustable length overhead truss when the plurality of wall panels are in the folded storage position.

12. The system of claim 1, wherein the plurality of wall panels are offset from a longitudinal axis of the adjustable length overhead truss when the plurality of wall panels are in the folded storage position.

13. The system of claim 11, wherein the first and second vertical supports each include a height adjustment mechanism configured to adjust the height of the adjustable length overhead truss.

14. The system of claim 13, wherein the height adjustment mechanisms include first and second adjustable foot portions coupled to the first and second vertical supports, respectively.

15. The system of claim 1, further comprising a third vertical support laterally spaced apart from the first vertical support, the third vertical support including a first end supported by a floor of the room and a second end coupled to the first vertical support and the first end truss member.

16. The system of claim 15, further comprising a plurality of support beams coupled between the first and third vertical supports and between the third vertical support and the first end truss section to provide lateral stability for the overhead truss.

17. The system of claim 15, wherein the first, second and third vertical supports each include a height adjustment mechanism configured to adjust the height of the adjustable length overhead truss.

18. The system of claim 17, wherein the height adjustment mechanisms include an adjustable foot portion coupled to each of the first, second and third vertical supports.

19. The system of claim 1, wherein the first and second end truss members are identically shaped.

20. A method for supporting an operable partition including a plurality of wall panels supported by a track to divide a room into a smaller area, the method comprising:

providing an adjustable length overhead truss including first and second end truss members and a center truss member movable relative to at least one of the first and second end truss members to adjust a length of the overhead truss;

adjusting a length of the overhead truss to a dimension of the room;

supporting the first end truss member with a first vertical support including a first end supported by a floor of the room and a second end coupled to the first end truss member;

supporting the second end truss member with a second vertical support including a first end supported by the floor of the room and a second end coupled to the second end truss member;

coupling a track to the adjustable length overhead truss;

coupling a plurality of wall panels to the track; and moving the plurality of wall panels from a folded storage position to a deployed use position to form a wall under the adjustable length overhead truss.

21. The method of claim 20, wherein step of providing an adjustable length overhead truss comprises:

providing identically shaped first and second end truss members;

providing a plurality of identically shaped modular truss sections;

assembling a plurality of the modular truss sections to form the center truss member having a desired length; and coupling the center truss member to the first and second end truss members.

22. The method of claim 21, wherein each of the first and second end truss members includes an open end to provide access to an interior region of each of the first and second end truss members, and wherein the step of coupling the center truss member to the first and second end truss members includes locating opposite ends of the center truss member in the interior regions of the first and second truss members.

23. The method of claim 22, wherein the step of adjusting a length of the overhead truss to a dimension of the room includes moving the opposite ends of the center truss member relative to the first and second end truss members in a telescoping manner.

24. The method of claim 20, further comprising adjusting a height of opposite ends of the adjustable length overhead truss using height adjustment mechanisms of the first and second vertical supports, respectively.

25. An adjustable support system for an operable partition including a plurality of wall panels supported by a track to divide a room into a smaller area, the support system comprising:

an adjustable length overhead truss including first and second end truss members and a center truss member movable relative to at least one of the first and second end truss members to adjust an overall length of the adjustable support system for the operable partition by changing a length of the overhead truss;

a first vertical support including a first end supported by a floor of the room and a second end coupled to the first end truss member;

a second vertical support including a first end supported by the floor of the room and a second end coupled to the second end truss member, the first and second vertical supports each including a height adjustment mechanism configured to adjust heights of the first and second end truss members independently to position the adjustable length overhead truss at a desired height within the room;

a track coupled to the adjustable length overhead truss; and a plurality of wall panels coupled to the track, the plurality of wall panels being movable from a folded storage position to a deployed use position to form a wall under the adjustable length overhead truss.

* * * * *